US009416789B2

(12) United States Patent
Bennitt

(10) Patent No.: US 9,416,789 B2
(45) Date of Patent: Aug. 16, 2016

(54) VALVE COVER GEOMETRY

(71) Applicant: Robert A. Bennitt, Painted Post, NY (US)

(72) Inventor: Robert A. Bennitt, Painted Post, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 14/487,229

(22) Filed: Sep. 16, 2014

(65) Prior Publication Data

US 2015/0152874 A1 Jun. 4, 2015

Related U.S. Application Data

(60) Provisional application No. 61/910,470, filed on Dec. 2, 2013.

(51) Int. Cl.

| | |
|---|---|
| ***F04B 39/10*** | (2006.01) |
| ***F04D 27/00*** | (2006.01) |
| ***F04D 29/08*** | (2006.01) |
| ***F04B 39/12*** | (2006.01) |

(52) U.S. Cl.

CPC ..... *F04D 27/001* (2013.01); *F04B 39/121* (2013.01); *F04B 39/123* (2013.01); *F04D 29/083* (2013.01)

(58) Field of Classification Search

CPC ..... F04B 39/10; F16J 13/00; F16J 13/02; Y10T 137/5762; Y10T 137/7558; Y10T 137/7668; B67D 7/3209; G21C 13/028

USPC ..... 73/40; 417/423.11, 423.14; 137/312, 137/455, 456, 459, 557

See application file for complete search history.

(56) References Cited

U.S. PATENT DOCUMENTS

| | | | | |
|---|---|---|---|---|
| 4,114,058 A * | 9/1978 | Albaric | ..... | F16J 15/008 277/431 |
| 6,301,319 B1 * | 10/2001 | Merkovsky | ..... | G21C 13/028 376/203 |
| 6,655,935 B2 * | 12/2003 | Bennitt | ..... | F04B 39/0016 417/523 |

* cited by examiner

*Primary Examiner* — Patrick Hamo

(57) ABSTRACT

A closure device for monitoring leakage of a process fluid through a bore of a compressor casing is provided. The closure device may include a body configured to be detachably coupled with the compressor casing about the bore of the compressor. The body may define a fluid passage and a plurality of grooves. The plurality of grooves may be defined about an outer circumferential surface of the body and may be axially spaced from one another. The closure device may also include a plurality of seals at least partially disposed in respective grooves of the plurality of grooves. The plurality of seals may be configured to engage an inner surface of the compressor casing such that adjacent seals of the plurality of seals at least partially define an annular gap therebetween fluidly coupled with the fluid passage and configured to contain the leakage of the process fluid.

14 Claims, 2 Drawing Sheets

VALVE COVER GEOMETRY

CROSS REFERENCE TO RELATED APPLICATIONS

This application claims the benefit of U.S. Provisional Patent Application having Ser. No. 61/910,470, which was filed Dec. 2, 2013. The aforementioned patent application is hereby incorporated by reference in its entirety into the present application to the extent consistent with the present application.

BACKGROUND

Compressors are often utilized in a myriad of applications and industrial processes to compress one or more process fluids (e.g., gases). Conventional compressors may often include a casing or cylinder having one or more valve assemblies (e.g., check valve assembly) configured to handle large volumes of the process fluids directed to and/or discharged from the compressor. The cylinder of the conventional compressors may often define one or more openings or bores and the valve assemblies may be disposed in the bores to handle the process fluids flowing therethrough. In operation, the process fluids contained in the cylinder of the compressors are often pressurized to relatively high pressures. Accordingly, the bores of the cylinders may typically include closure devices or covers configured to seal the bores to prevent leakage of the pressurized process fluids from the cylinder to the surrounding atmosphere. In addition to sealing the bores, the covers may also be configured to retain the valve assemblies within the bores of the compressors.

As advancements are made in the industrial processes, however, production requirements for the conventional compressors are often heightened. In many cases, to meet the heightened production requirements, the process fluids may be pressurized to relatively higher pressures. The higher pressures of the process fluids in the compressors may subsequently expose the cylinder and the covers sealing the bores and/or retaining the valve assemblies disposed therein to increased pressures. The covers in conventional compressors, however, may not be capable of sufficiently sealing the bores and/or retaining the valve assemblies disposed therein, thereby resulting in leakage of the process fluid from the cylinder to the surrounding atmosphere via the bores and/or the valve assemblies. Further, the covers in conventional compressors may not provide a means to monitor the leakage of the process fluids from the cylinders, which may present a hazardous and/or fatal environment for nearby operators. For example, the process fluids may often contain one or more hazardous gases (e.g., hydrogen sulfide), which have been proven to be fatal in quantities as small as 20 parts per million (ppm). In another example, the leaked process fluids may contain one or more volatile hydrocarbons, which may combine with the surrounding atmosphere in stoichiometric mixtures to provide a potentially explosive environment.

What is needed, then, are improved covers and methods for sealing bores defined in a cylinder of a compressor and/or retaining valve assemblies disposed in the bores that are capable of monitoring leakage of process fluids from the cylinder of the compressor.

SUMMARY

Embodiments of the disclosure may provide a closure device for monitoring leakage of a process fluid through a bore of a compressor casing. The closure device may include a body configured to be detachably coupled with the compressor casing about the bore of the compressor. The body may define a fluid passage and a plurality of grooves. The plurality of grooves may be defined about an outer circumferential surface of the body and may be axially spaced from one another. The closure device may also include a plurality of seals at least partially disposed in respective grooves of the plurality of grooves. The plurality of seals may be configured to engage an inner surface of the compressor casing such that adjacent seals of the plurality of seals at least partially define an annular gap therebetween fluidly coupled with the fluid passage and configured to contain the leakage of the process fluid.

Embodiments of the disclosure may also provide a compressor including a cylinder defining a cavity configured to contain a process fluid, a bore fluidly coupled with and extending from the cavity to and through an outer surface of the cylinder, and a channel fluidly coupled with and extending from the bore. The compressor may also include a valve assembly disposed in the bore and configured to control a flow of the process fluid between the channel and the cavity. The compressor may further include a closure device configured to be detachably coupled with the cylinder about the bore and to monitor leakage of the process fluid through the bore of the cylinder. The closure device may include a body defining a plurality of grooves about an outer circumferential surface thereof and axially spaced from one another. The closure device may also include a plurality of seals, where each seal of the plurality of seals may be at least partially disposed in a respective groove of the plurality of grooves. Each seal of the plurality of seals may be configured to engage an inner surface of the cylinder defining the bore such that adjacent seals of the plurality of seals at least partially define an annular gap therebetween. The annular gap may be fluidly coupled with a fluid passage at least partially extending through the body and configured to contain the leakage of the process fluid.

Embodiments of the disclosure may further provide a valve cover including a valve body having a domed portion and a flange extending from the domed portion. The flange of the valve cover may define a plurality of openings extending therethrough. The valve cover may also include an annular rib extending from the valve body. The annular rib may define a first groove and a second groove about an outer circumferential surface thereof and axially spaced from one another. A first seal may be at least partially disposed in the first groove, and a second seal may be at least partially disposed in the second groove. The first and second seals may at least partially define an annular gap therebetween configured to contain leakage of a process fluid. The valve body may define a fluid passage at least partially extending therethrough and fluidly coupled with the annular gap.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
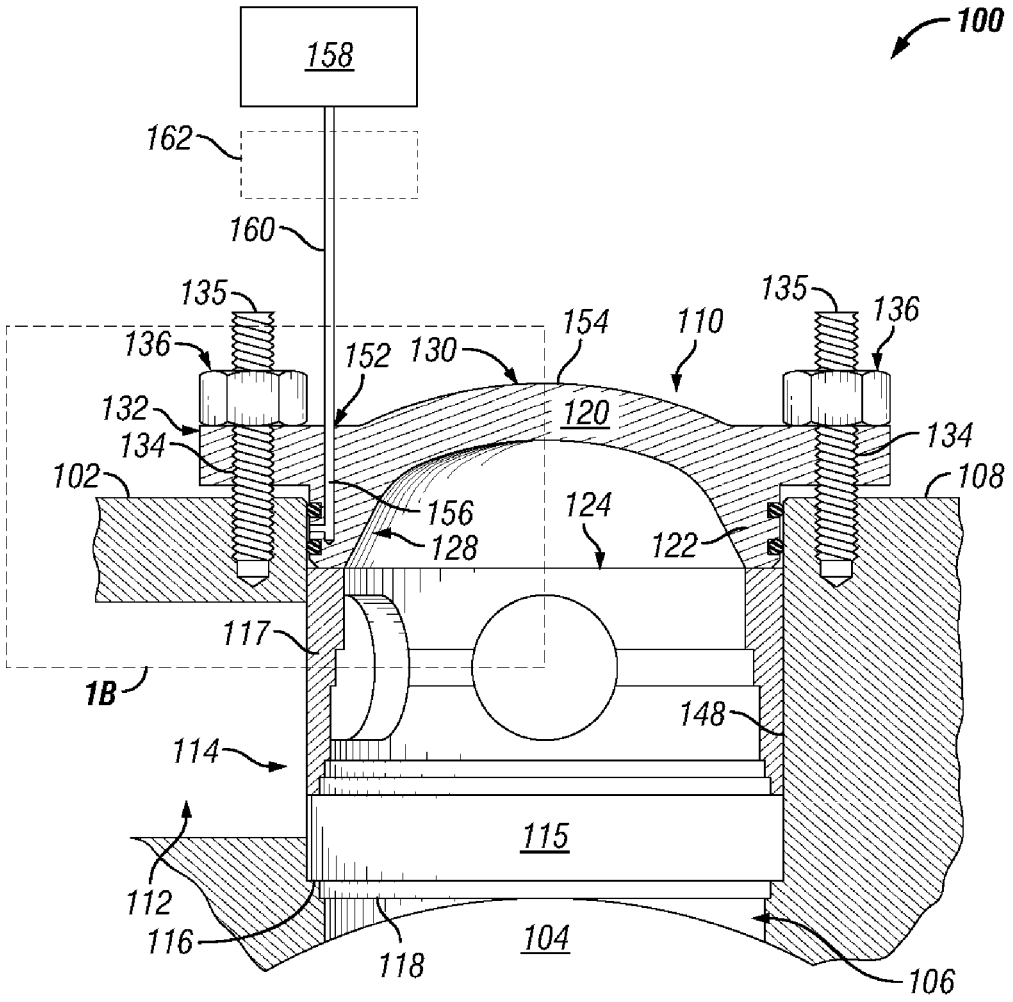
FIG. 1A illustrates a partial cross-sectional view of a portion of a casing of a compressor having a valve assembly and a valve cover, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1A illustrates a partial cross sectional view of a portion of a casing 102 of a compressor 100 including a closure device, such as a valve cover 110, according to one or more embodiments. The casing 102, illustrated as a cylinder in FIG. 1A, may at least partially define a cavity 104 of the compressor 100 configured to contain one or more process fluids (e.g., gases and/or liquids). In at least one embodiment, a compressor piston (not shown) may be at least partially disposed in the cavity 104 and configured to reciprocate therein to compress the process fluids. The cylinder 102 may also at least partially define a bore 106 fluidly coupled with and extending from the cavity 104 of the compressor 100 to and through an outer surface 108 of the cylinder 102, and a channel 112 fluidly coupled with and extending from the bore 106. The channel 112 may be an inlet or an outlet of the compressor 100.

In at least one embodiment, a valve assembly 114 including a valve 115 and a valve crab 117 may be at least partially disposed in the bore 106 and configured to control a flow of the process fluids between the cavity 104 and the channel 112. For example, the cylinder 102 may define a shoulder 116 configured to at least partially support a first end portion 118 of the valve assembly 114. The valve 115 may define or include a plurality of holes (not shown) extending therethrough and configured to provide fluid communication between the cavity 104 and the channel 112. In at least one embodiment, one or more gaskets (not shown) may be disposed between the first end portion 118 of the valve assembly 114 and the shoulder 116. The gaskets may be configured to prevent leakage of the process fluids between the valve assembly 114 and the shoulder 116. The gaskets may include, but are not limited to, one or more metallic gaskets, elastomeric gaskets, or the like.

Figure 1B:
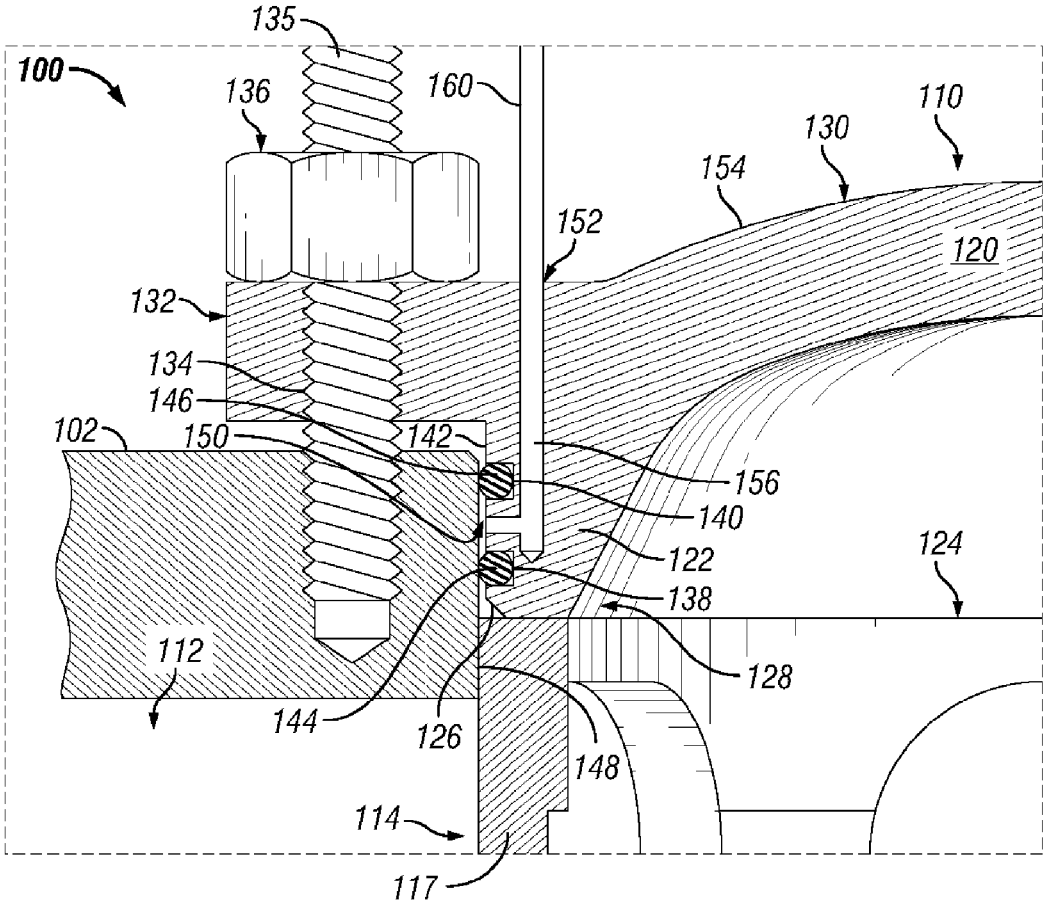
FIG. 1B illustrates an enlarged view of the portion of the casing of the compressor indicated by the box labeled "1B" of FIG. 1A, according to one or more embodiments disclosed.

In at least one embodiment, the valve cover 110 may be detachably coupled with the cylinder 102 about the bore 106 and configured to seal the bore 106 and/or retain the valve assembly 114 within the bore 106 of the compressor 100. For example, the valve cover 110 may include a body 120 configured to detachably couple the valve cover 110 with the cylinder 102, and an annular rib 122 extending from the body 120 and configured to retain the valve assembly 114 within the bore 106 of the compressor 100. The annular rib 122 may extend downwardly from the body 120 and be at least partially disposed in the bore 106 to engage and/or apply a force to a second end portion 124 of the valve assembly 114 to retain the valve assembly 114 within the bore 106 of the compressor 100. The force applied to the second end portion 124 of the valve assembly 114 may retain or hold the first end portion 118 of the valve assembly 114 adjacent the shoulder 116 defined in the bore 106. In at least one embodiment, the annular rib 122 may define a chamfered surface or edge 126 (FIG. 1B) configured to facilitate the insertion of the annular rib 122 into the bore 106. For example, as illustrated in FIG. 1B, the annular rib 112 may define the chamfered edge 126 at a first end portion 128 thereof to facilitate the insertion of the annular rib 122 into the bore 106 of the compressor 100.

In at least one embodiment, the body 120 may be or include a plate or an annular disk having a uniform thickness. In another embodiment, the body 120 may include a domed or curved portion 130 and a flange portion 132 extending radially outward from the curved portion 130. The flange portion 132 may be configured to detachably couple the body 120 of the valve cover 110 with the cylinder 102. For example, as illustrated in FIG. 1A, the flange portion 132 may extend over and be spaced outward from the outer surface 108 of the cylinder 102 and may define one or more circumferentially-arrayed openings (two are shown 134) extending therethrough. The openings 134 defined in the flange portion 132 may be configured to receive one or more mechanical fasteners, illustrated as studs 135 and nuts 136. The studs 135 may extend into and engage corresponding threads formed in the cylinder 102 and the nuts 136 may be fastened to the studs 135 to couple the valve cover 110 with the cylinder 102. In addition to, or in substitution of the studs 135 and the nuts 136, the mechanical fasteners may include one or more bolts and/or any other known mechanical fasteners. In at least one embodiment, at least a portion of the force applied from the annular rib 122 to the second end portion 124 of the valve assembly 114 to retain the valve assembly 114 within the bore 106 of the compressor 100 may be provided by the studs 135 and the nuts 136. For example, the torque applied to the nuts 136 to couple the valve cover 110 with the cylinder 102 may be increased or decreased to correspondingly increase or decrease the force applied to the second end portion 124 of the valve assembly 114.

In at least one embodiment, the valve cover 110 may be configured to provide a fluid tight seal with the cylinder 102 to at least partially prevent leakage of the process fluids from the compressor 100 to an external environment (e.g., the atmosphere) via the bore 106. For example, as illustrated in FIG. 1B, the valve cover 110 may define two or more recesses or grooves (two are shown 138, 140) about an outer circumferential surface 142 of the annular rib 122 and having respective seals 144, 146 (e.g., O-rings) at least partially disposed therein. As illustrated in FIG. 1B, a first groove 138 may be disposed near or proximal the first end portion 128 of the annular rib 122, and a second groove 140 may be axially spaced from the first groove 138. In at least one embodiment, a first seal 144 and a second seal 146 may be at least partially disposed in the first groove 138 and the second groove 140, respectively, to provide the fluid tight seal between the valve cover 110 and the cylinder 102. For example, the first and second seals 144, 146 may at least partially extend from the respective grooves 138, 140 to engage an inner surface 148 of the casing 102 defining the bore 106 to provide the fluid tight seal between the valve cover 110 and the cylinder 102. In at least one embodiment, the first and second seals 144, 146 may at least partially define an annular gap 150 therebetween. For example, as illustrated in FIG. 1B, the axially spaced seals 144, 146 may engage the inner surface 148 to define the annular gap 150.

In at least one embodiment, the pressure exerted on or experienced by the first seal 144 may be at least partially determined by the pressure of the process fluids contained in the cavity 104, the channel 112, and/or the valve assembly 114 of the compressor 100. Further, the pressure exerted on or experienced by the second seal 146 may be at least partially determined by the pressure of the process fluids contained in the annular gap 150 and/or the pressure of the exterior environment (i.e., atmospheric pressure). In an exemplary embodiment, the pressure exerted on the first seal 144 may be relatively greater than the pressure exerted on the second seal 146. For example, the first seal 144 may provide a fluid tight seal between the valve cover 110 and the bore 106 sufficient to prevent all or substantially all of the process fluids from flowing or leaking from the cavity 104, the channel 112, and/or the valve assembly 114 to the annular gap 150. Preventing all or substantially all of the process fluid from flowing or leaking to the annular gap 150 may subsequently prevent the pressure of the process fluids contained in the cavity 104, the channel 112, and/or the valve assembly 114 from being exerted on the second seal 146. Accordingly, the first seal 144 may prevent the pressure of the process fluid contained in the cavity 104, the channel 112, and/or the valve assembly 114 from being exerted on the second seal 146. In at least one embodiment, the second seal 146 may provide a fluid tight seal between the valve cover 110 and the bore 106 sufficient to prevent all or substantially all of the process fluids from flowing or leaking from the annular gap 150 to the external environment.

In at least one embodiment, the body 120 of the valve cover 110 may define a port or opening 152 along an outer surface 154 thereof that may be fluidly coupled with the annular gap 150. For example, as illustrated in FIGS. 1A and 1B, the valve cover 110 may define a fluid passage 156 extending between and fluidly coupling the opening 152 and the annular gap 150. In at least one embodiment, illustrated in FIG. 1A, the opening 152 may be fluidly coupled with one or more downstream processing systems 158 via a conduit or piping 160. The downstream processing systems 158 may be configured to process and/or dispose of the process fluids leaked from the compressor 100 and/or the annular gap 150. Accordingly, it may be appreciated that the downstream processing systems 158 may prevent the leakage of the process fluids from the compressor 100 and/or the annular gap 150 to the surrounding environment, thereby providing a safer environment for nearby operators.

As previously discussed, the first seal 144 may prevent the relatively greater pressure of the process fluid contained in the cavity 104, the channel 112, and/or the valve assembly 114 from being exerted on the second seal 146. In at least one embodiment, the increased pressure of the process fluids exerted on the first seal 144 may cause the process fluids to diffuse into at least a portion of the first seal 144. During one or more decompression events (e.g., blow down events) the process fluids contained in the first seal 144 may depressurize and rapidly expand therein, thereby compromising the structural integrity of the first seal 144. For example, the depressurization and rapid expansion of the process fluids within in the first seal 144 may cause the first seal 144 to rupture (i.e., explosive decompression). In at least one embodiment, the second seal 146 may be configured to maintain the fluid tight seal between the valve cover 110 and the cylinder 102 upon failure of the first seal 144. Accordingly, the process fluids traversing past the ruptured first seal 144 may be retained in the annular gap 150 by the second seal 146, and subsequently exhausted to the one or more downstream processing system 158 via the fluid passage 156 and the piping 160.

In at least one embodiment, one or more devices 162 may be fluidly coupled with or disposed in the piping 160. For example, as illustrated in FIG. 1A, the devices 162 may be fluidly coupled with the piping 160 between the compressor 100 and the downstream processing systems 158. Illustrative devices 162 may include, but are not limited to, one or more flow meters, gas monitors, gas detectors, pressure sensors, or any other devices desirable for monitoring, processing, and/or outputting information related to the leakage or flow of the process fluids from the compressor 100 and/or the annular gap 150. In an exemplary embodiment, the devices 162 include a flow meter, such as a Venturi flow meter, a Coriolis flow meter, a pressure flow meter, stroke counter, impeller flow meter, or the like, or any combination thereof. The flow meter may be configured to monitor or measure the volumetric flow and/or the mass flow of the process fluids leaking from the compressor 100 and/or the annular gap 150.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

I claim:

1. A closure device for monitoring leakage of a process fluid through a bore of a compressor casing, comprising:

a body configured to be detachably coupled with the compressor casing about the bore, the body comprising:

a domed portion;

a flange extending radially outward from the domed portion, the flange defining a plurality of openings extending therethrough, each opening of the plurality of openings being configured to receive a respective mechanical fastener to detachably couple the body with the compressor casing; and an annular rib extending axially and configured to be at least partially disposed in the bore of the compressor casing, the annular rib defining a plurality of grooves about an outer circumferential surface thereof and axially spaced from one another; and a plurality of seals, each seal of the plurality of seals is at least partially disposed in a respective groove of the plurality of grooves and configured to engage an inner surface of the compressor casing defining the bore such that adjacent seals of the plurality of seals at least partially define an annular gap therebetween configured to contain the leakage of the process fluid, wherein the annular rib at least partially defines a fluid passage fluidly coupled with the annular gap.

2. The closure device of claim 1, wherein the fluid passage is fluidly coupled with a flow meter configured to monitor the leakage of the process fluid from the compressor casing to the annular gap.

3. The closure device of claim 2, wherein the flow meter is selected from the group consisting of a Venturi flow meter, a Coriolis flow meter, a pressure flow meter, a stroke counter, and an impeller flow meter.

4. A compressor, comprising:

a cylinder defining a cavity configured to contain a process fluid, a bore fluidly coupled with and extending from the cavity to and through an outer surface of the cylinder, and a channel fluidly coupled with and extending from the bore;

a valve assembly disposed in the bore of the compressor and configured to control a flow of the process fluid between the channel and the cavity; and a closure device configured to be detachably coupled with the cylinder about the bore and to monitor leakage of the process fluid through the bore of the cylinder, the closure device comprising:

a body comprising:

a domed portion;

a flange extending radially outward from the domed portion, the flange defining a plurality of circumferentially-arrayed openings extending therethrough, each circumferentially-arrayed opening of the plurality of circumferentially-arrayed openings being configured to receive a respective mechanical fastener to detachably couple the closure device with the cylinder; and an annular rib extending axially into the bore and configured to engage the valve assembly to retain the valve assembly within the bore, the annular rib defining a plurality of grooves about an outer circumferential surface thereof and axially spaced from one another; and a plurality of seals, each seal of the plurality of seals being at least partially disposed in a respective groove of the plurality of grooves and configured to engage an inner surface of the cylinder defining the bore such that adjacent seals of the plurality of seals at least partially define an annular gap therebetween, wherein the annular rib at least partially defines a fluid passage, the annular gap is fluidly coupled with the fluid passage at least partially extending through the annular rib, and the annular gap is configured to contain the leakage of the process fluid.

5. The compressor of claim 4, further comprising a flow meter fluidly coupled with the fluid passage and configured to monitor the leakage of the process fluid from the cavity to the annular gap.

6. The compressor of claim 5, wherein the flow meter is selected from the group consisting of a Venturi flow meter, a Coriolis flow meter, a pressure flow meter, a stroke counter, and an impeller flow meter.

7. The compressor of claim 4, wherein the fluid passage is fluidly coupled with a downstream processing system configured to dispose of the leakage of the process fluid contained in the annular gap.

8. The compressor of claim 4, wherein the fluid passage is fluidly coupled with a device configured to monitor the leakage of the process fluid through the bore of the cylinder.

9. The compressor of claim 8, wherein the device is selected from the group consisting of a flow meter, a gas monitor, a gas detector, and a pressure sensor.

10. A compressor, comprising:

a cylinder defining a cavity configured to contain a process fluid, a bore fluidly coupled with and extending from the cavity to and through an outer surface of the cylinder, and a channel fluidly coupled with and extending from the bore;

a valve assembly disposed in the bore and configured to control a flow of a process fluid between the channel and the cavity;

and a valve cover, the valve cover comprising:

a valve body comprising a domed portion and a flange extending from the domed portion, the flange defining a plurality of openings extending therethrough;

an annular rib extending from the valve body, the annular rib defining a first groove and a second groove axially spaced from one another and about an outer circumferential surface of the annular rib;

a first seal at least partially disposed in the first groove; and a second seal at least partially disposed in the second groove, the first and second seals defining an annular gap therebetween configured to contain leakage of the process fluid, wherein the annular rib at least partially defines a fluid passage fluidly coupled with the annular gap, wherein the first and second seals engage an inner surface of the cylinder defining the bore to at least partially define the annular gap configured to contain the leakage of the process fluid.

11. The compressor of claim 10, wherein the fluid passage is fluidly coupled with a device configured to monitor the leakage of the process fluid through the fluid passage, and the device is selected from the group consisting of a flow meter, a gas monitor, a gas detector, and a pressure sensor.

12. The compressor of claim 10, further comprising a flow meter fluidly coupled with the fluid passage and configured to monitor the leakage of the process fluid from the cavity to the annular gap.

13. The compressor of claim 12, wherein the flow meter is selected from the group consisting of a Venturi flow meter, a Coriolis flow meter, a pressure flow meter, a stroke counter, and an impeller flow meter.

14. The compressor of claim 10, wherein the fluid passage is fluidly coupled with a downstream processing system configured to dispose of the process fluid contained in the annular gap.

* * * * *